US008042559B2

(12) United States Patent
Choi et al.

(10) Patent No.: US 8,042,559 B2
(45) Date of Patent: Oct. 25, 2011

(54) DISHWASHER HAVING RACK WITH SHELF HOLDER

(75) Inventors: Yong Jin Choi, Seoul (KR); Nung Seo Park, Seoul (KR); Young Hwan Park, Seoul (KR); Gap Su Shin, Chungju-si (KR)

(73) Assignee: LG Electronics Inc., Seoul (KR)

( * ) Notice: Subject to any disclaimer, the term of this patent is extended or adjusted under 35 U.S.C. 154(b) by 846 days.

(21) Appl. No.: 11/846,592

(22) Filed: Aug. 29, 2007

(65) Prior Publication Data

US 2008/0110481 A1 May 15, 2008

(30) Foreign Application Priority Data

Nov. 15, 2006 (KR) ..... 10-2006-0112901

(51) Int. Cl.
*B08B 3/00* (2006.01)
*A47G 19/08* (2006.01)

(52) U.S. Cl. ..... 134/137; 134/164; 211/41.8; 211/41.9

(58) Field of Classification Search ..... 134/137, 134/164; 211/41.8, 41.9
See application file for complete search history.

(56) References Cited

U.S. PATENT DOCUMENTS

| | | | | |
|---|---|---|---|---|
| 4,917,248 | A * | 4/1990 | Friskney | 211/41.8 |
| 5,344,029 | A * | 9/1994 | Oghia et al. | 211/41.8 |
| 5,351,837 | A * | 10/1994 | Smith | 211/41.8 |
| 2005/0109378 | A1 * | 5/2005 | Landsiedel et al. | 134/135 |

FOREIGN PATENT DOCUMENTS

| | | | |
|---|---|---|---|
| DE | 3022484 | A * | 1/1982 |
| EP | 1275336 | A1 * | 1/2003 |
| FR | 2775180 | A1 * | 8/1999 |
| JP | 2006239140 | A * | 9/2006 |
| WO | WO 0187133 | A1 * | 11/2001 |

OTHER PUBLICATIONS

FR 2 775 180 Machine Translation.*
FR 2 775 180 Machine Translation Aug. 1999 CHATEAU.*

* cited by examiner

*Primary Examiner* — Michael Barr
*Assistant Examiner* — Charles W Kling
(74) *Attorney, Agent, or Firm* — KED & Associates LLP

(57) ABSTRACT

A dishwasher is disclosed which includes a rack arranged inside of a washing cabinet, a plurality of shelves arranged on the rack, and a shelf holder installed on the rack. The shelf holder may include a plurality of shelf fixing parts that fix the shelves together. The dishwasher so configured is capable of minimizing the number of shelf holders needed to fix a plurality of shelves to a rack and, therefore, simplifies the assembly process.

14 Claims, 9 Drawing Sheets

DISHWASHER HAVING RACK WITH SHELF HOLDER

This Nonprovisional application claims priority under 35 U.S.C. §119(a) to Patent Application No. 10-2006-0112901 filed in Korea on Nov. 15, 2006, the entire contents of which are hereby incorporated by reference.

BACKGROUND

1. Field

A dishwasher having a rack with a shelf holder is disclosed herein.

2. Description of the Related Art

A dishwasher is an apparatus that washes food remnants adhered to dishes, cups, culinary tools, and similar items (hereinafter, referred to as 'dishes') using washing water and detergent. Dishwashers generally include racks inside of a washing tank or cabinet on which the dishes are placed. The racks are capable of being inserted into and withdrawn from the washing cabinet. However, related art dishwashers have various disadvantages in the configuration of the racks and shelves mounted thereto.

BRIEF DESCRIPTION OF THE DRAWING

Embodiments will be described in detail with reference to the following drawings in which like reference numerals refer to like elements, and wherein.

DETAILED DESCRIPTION

Hereinafter, a dishwasher according to the embodiments will be described in detail with reference to the accompanying drawings.

Figure 1:
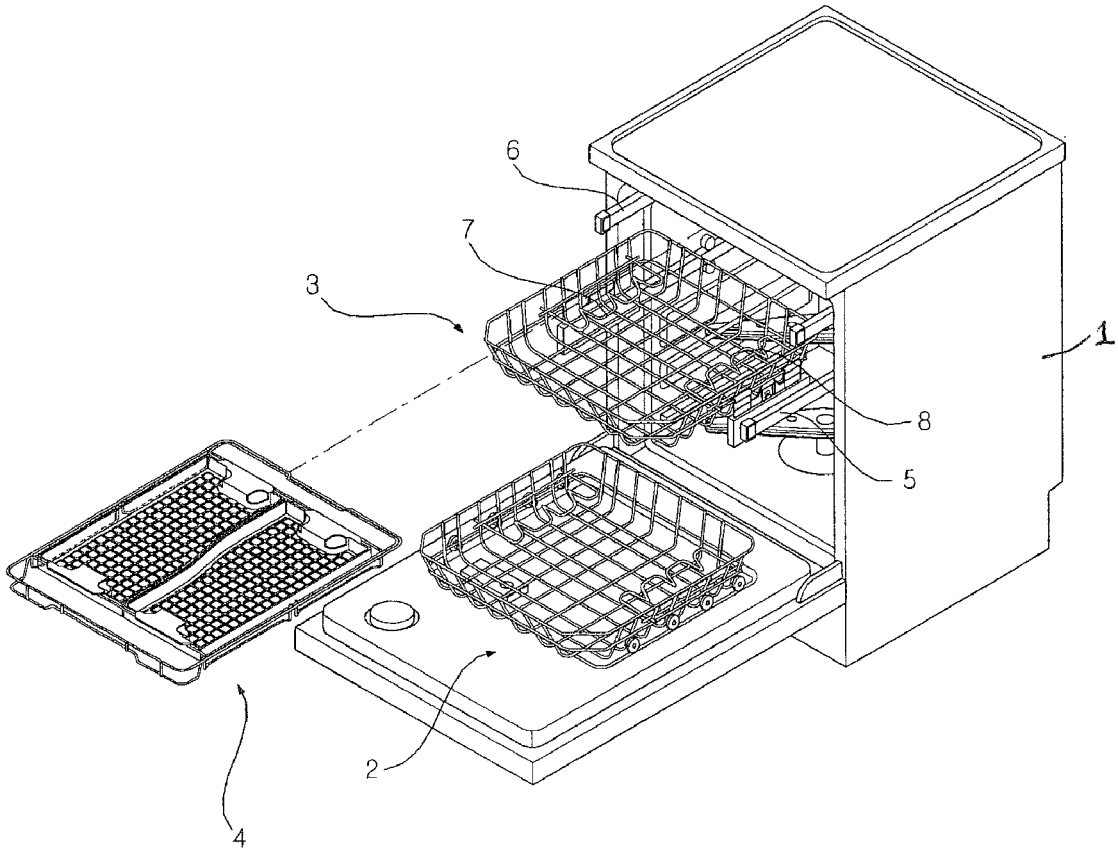
FIG. 1 is an exploded perspective view of a dishwasher according to an embodiment.

FIG. 1 is an exploded perspective view of a dishwasher according to an embodiment. The dishwasher of FIG. 1 may include a wash tank or cabinet 1 and a plurality of rack assemblies 2, 3, 4 arranged within the washing tank or cabinet 1 on which dishes may be placed. The washing cabinet 1 may include guides 5, 6 that guide movement of the rack assemblies 2, 3. At least one of the rack assemblies may include a plurality of shelves 7, 8 on which cups or similar dishware may be placed.

Figure 2:
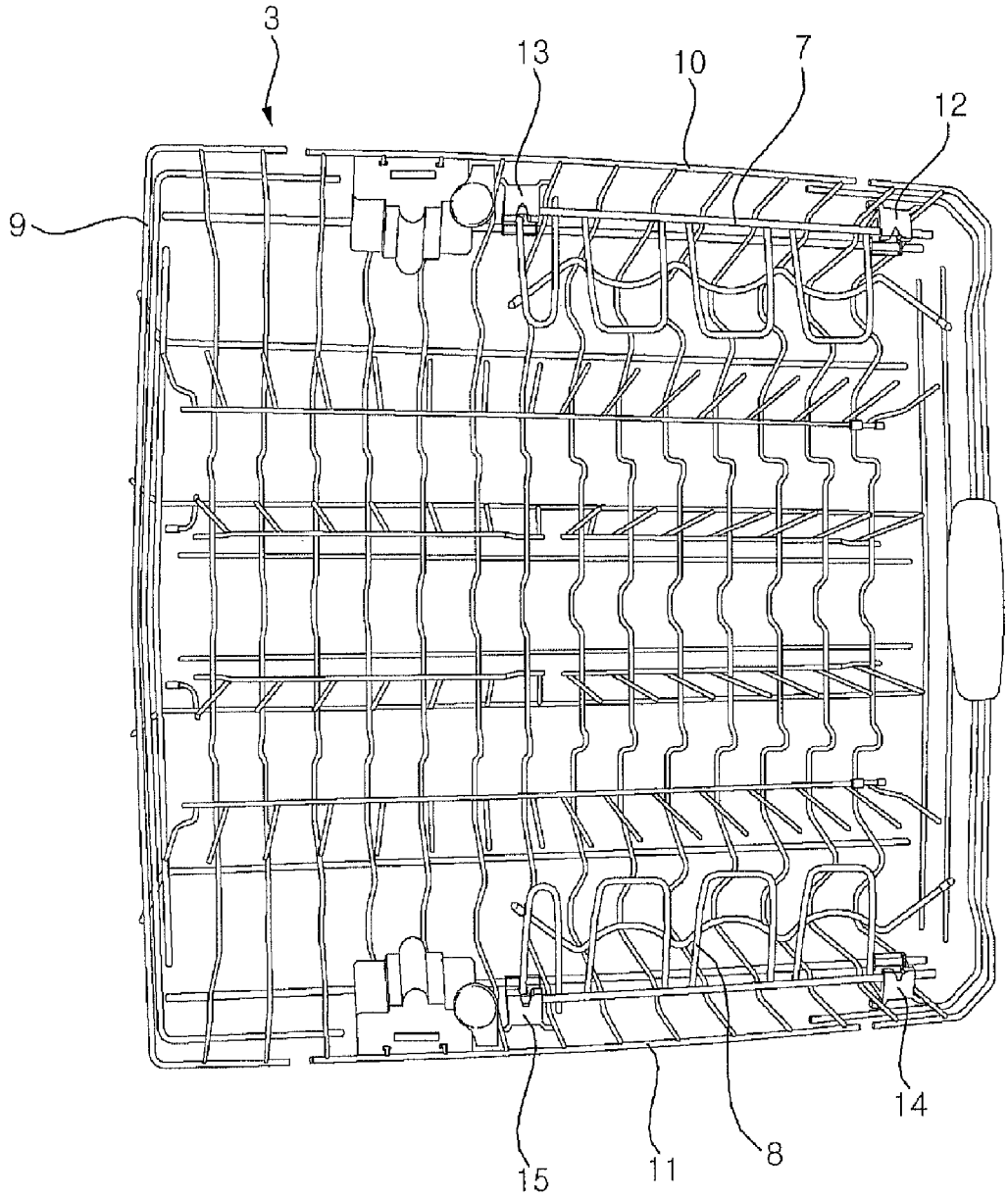
FIG. 2 is a plan view of a tack assembly of the dishwasher of FIG. 1.

FIG. 2 is a plan view of a rack assembly of the dishwasher of FIG. 1. The rack assembly 3 may include a rack 9, on which shelves 7, 8 may be mounted, using shelf holders 12, 13, 14, 15 that fix the shelves 7, 8 at front and rear sides, respectively, of left and right sides 10, 11 of the rack 9. That is, the front left side shelf holder 12 and the rear left side shelf holder 13 may be mounted at the left side 10 of the rack 9. A distance between shelf holders 12, 13 may be shorter than a length of the left shelf 7. Accordingly, a front portion of the left shelf 7 may be fixed by the front left side shelf holder 12 and a rear portion of the left shelf 7 may be fixed to the rack 9 by the rear left side shelf holder 13.

Further, the front right side shelf holder 14 and the rear left side shelf holder 15 may be mounted at the right side 11 of the rack 9. A distance between shelf holders 14, 15 may be shorter than a length of the right shelf 8. Accordingly, a front portion of the right shelf 8 may be fixed to the rack 9 by the front right side shelf holder 14 and a rear portion of the right shelf 8 may be fixed to the rack 9 by the rear right side shelf holder 15.

However, the dishwasher of FIGS. 1-2 needs two shelf holders per shelf to fix the front and rear portion of the left and right side shelves 7, 8 with shelf holders 12, 13, 14, 15; therefore, mounting two shelves 7, 8 requires four total shelf holders 12, 13, 14, 15, thus leading to an increase in the number of parts required and causing the assembly process of the plurality of shelves 7, 8 and shelf holders 12, 13, 14, 15 to be more complicated.

Figure 3:
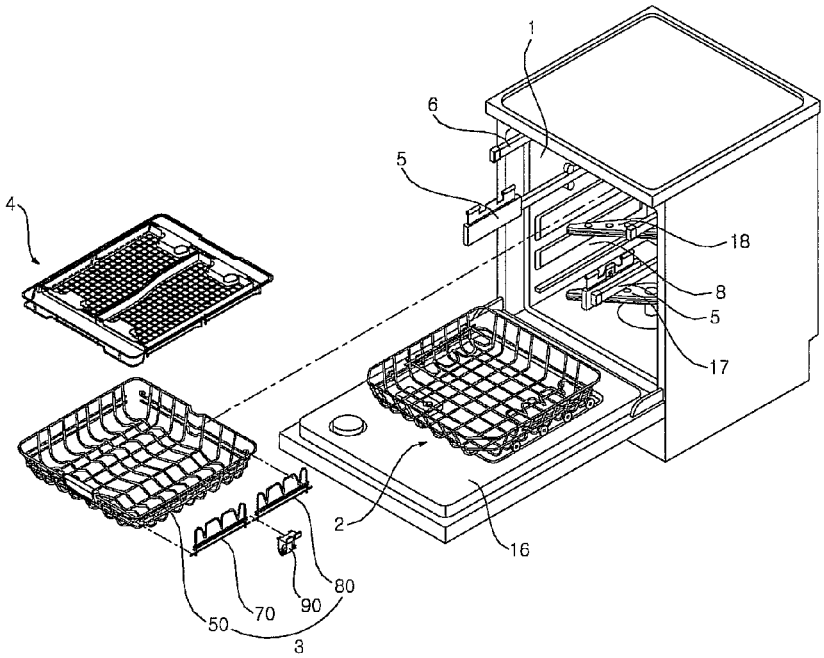
FIG. 3 is an exploded perspective view of a dishwasher according to another embodiment.

FIG. 3 is an exploded perspective view of a dishwasher according to an embodiment. The dishwasher of FIG. 3 may include a washing cabinet 1 and rack assemblies 2, 3, 4 arranged to be inserted into and withdrawn from the inside of the wash cabinet 1. The wash tank 1 may include guides 5, 6 that guide movement of the rack assemblies 2, 3. A door 16 may be arranged at a front of the washing cabinet 1 to open/close a front opening of the washing cabinet 1.

The wash tank 1 may also include nozzles 17,18 that spray washing water toward the rack assemblies 2, 3, 4. A sump (not shown) may be installed at a lower part of the washing cabinet 1 to collect washing water. The sump may be connected to a pumping device that pumps washing water from the sump to the nozzles 17, 18, a water supplying device that supplies washing water to the inside of the sump, and a discharging device that discharges washing water from the sump to the outside.

The rack assemblies 2, 3, 4 may be arranged to be spaced from one another in an upward and downward direction. The rack assemblies 2, 3 may be designed to receive plates and similar dishware thereon and the other rack assembly 4 may be designed to receive cutlery or other cooking utensils thereon.

The rack assemblies 2, 3 may each include a rack 50 designed to receive plates and similar dishware thereon, shelves 70, 80 to receive cups and similar dishware thereon, and a shelf holder 90 mounted on the rack 50 to hold the shelves 70, 80 to the rack 50.

Figure 4:
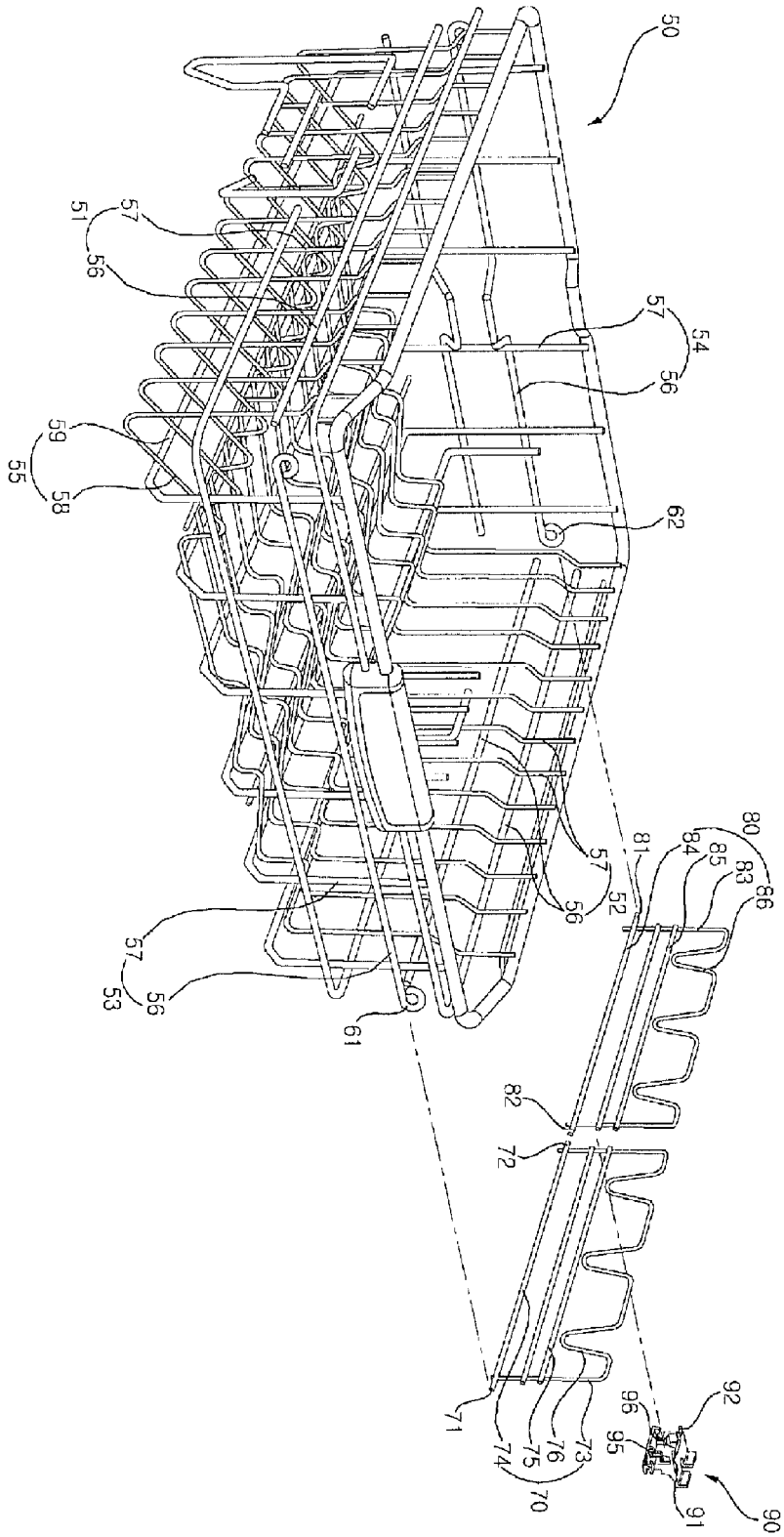
FIG. 4 is an exploded perspective view of a rack assembly of FIG. 3.
Figure 5:
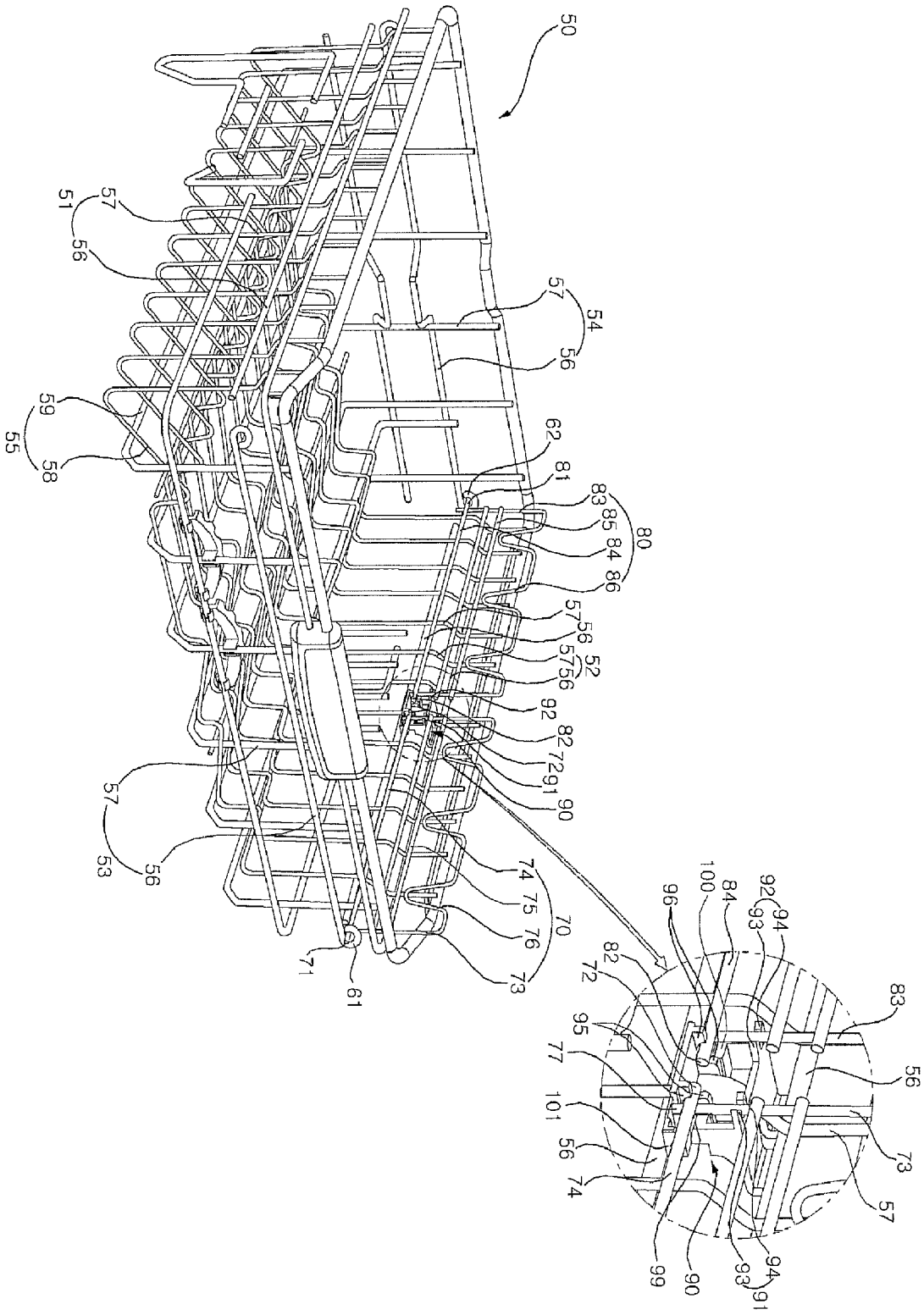
FIG. 5 is another exploded perspective view of a rack assembly of FIG. 3, showing shelves in an upright position.
Figure 6:
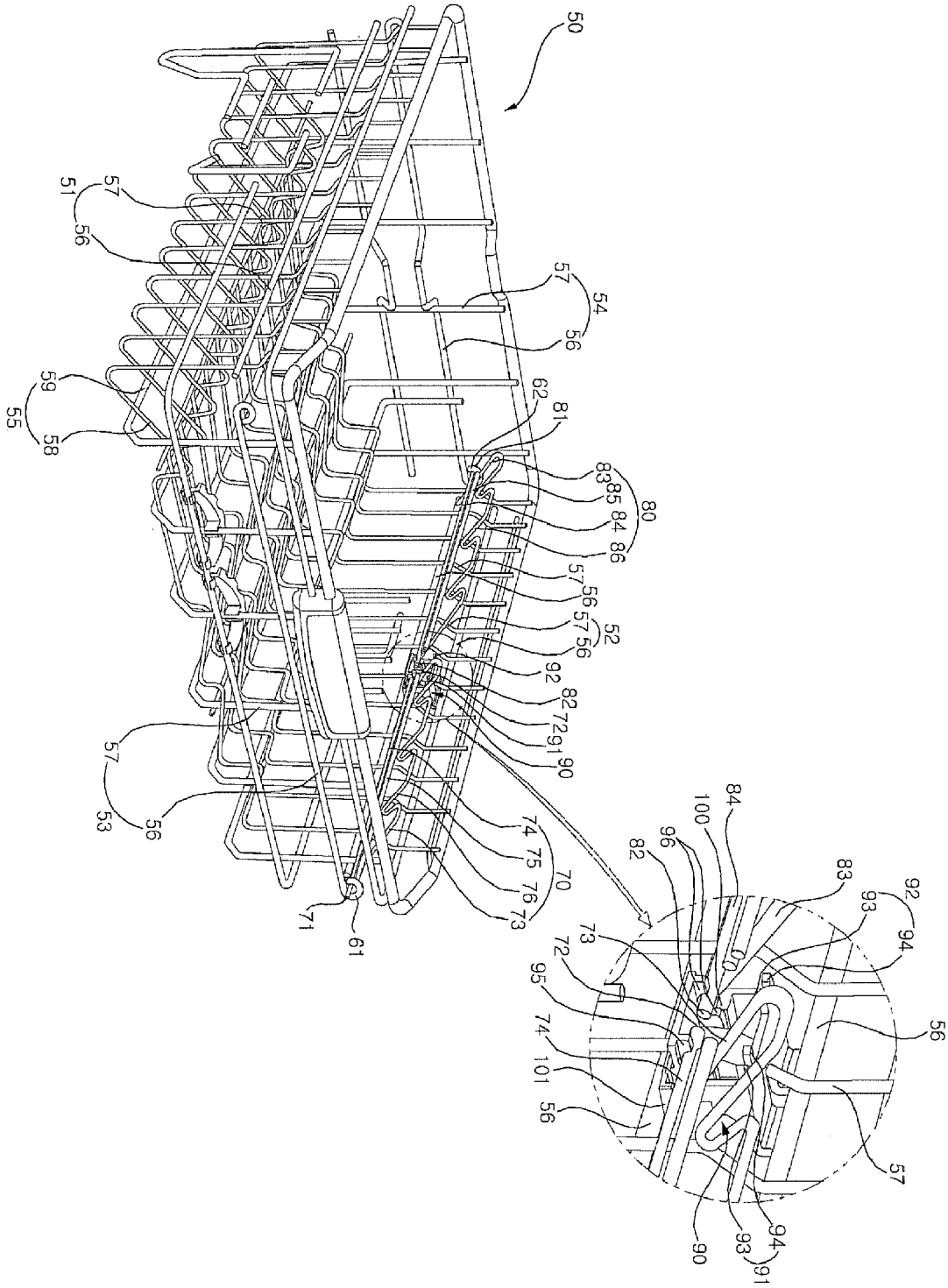
FIG. 6 is another exploded perspective view of a tack assembly of FIG. 3, showing shelves in a laid down position.
Figure 7:
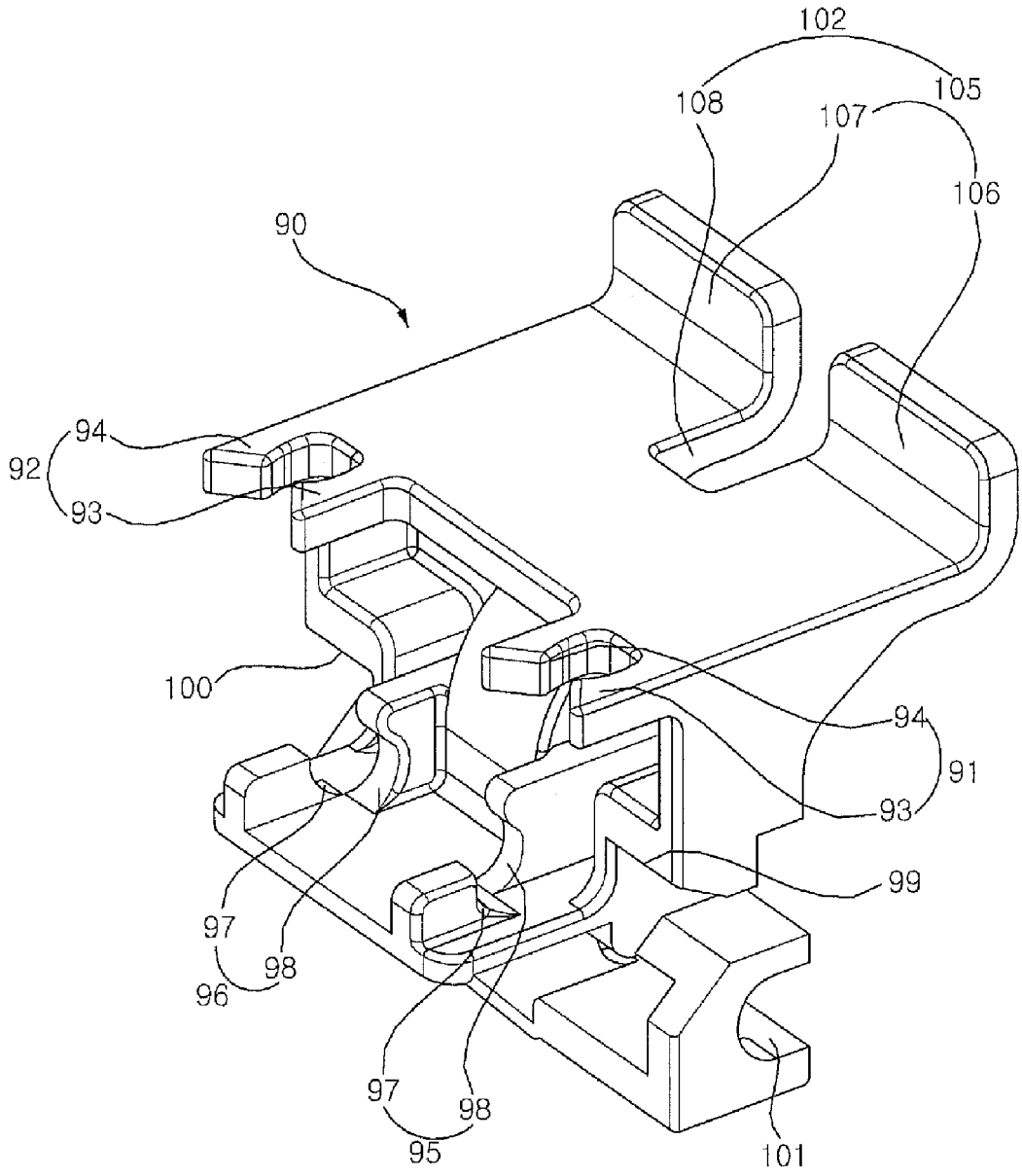
FIG. 7 is a perspective view of a shelf holder of a rack assembly of FIG. 3.
Figure 8:
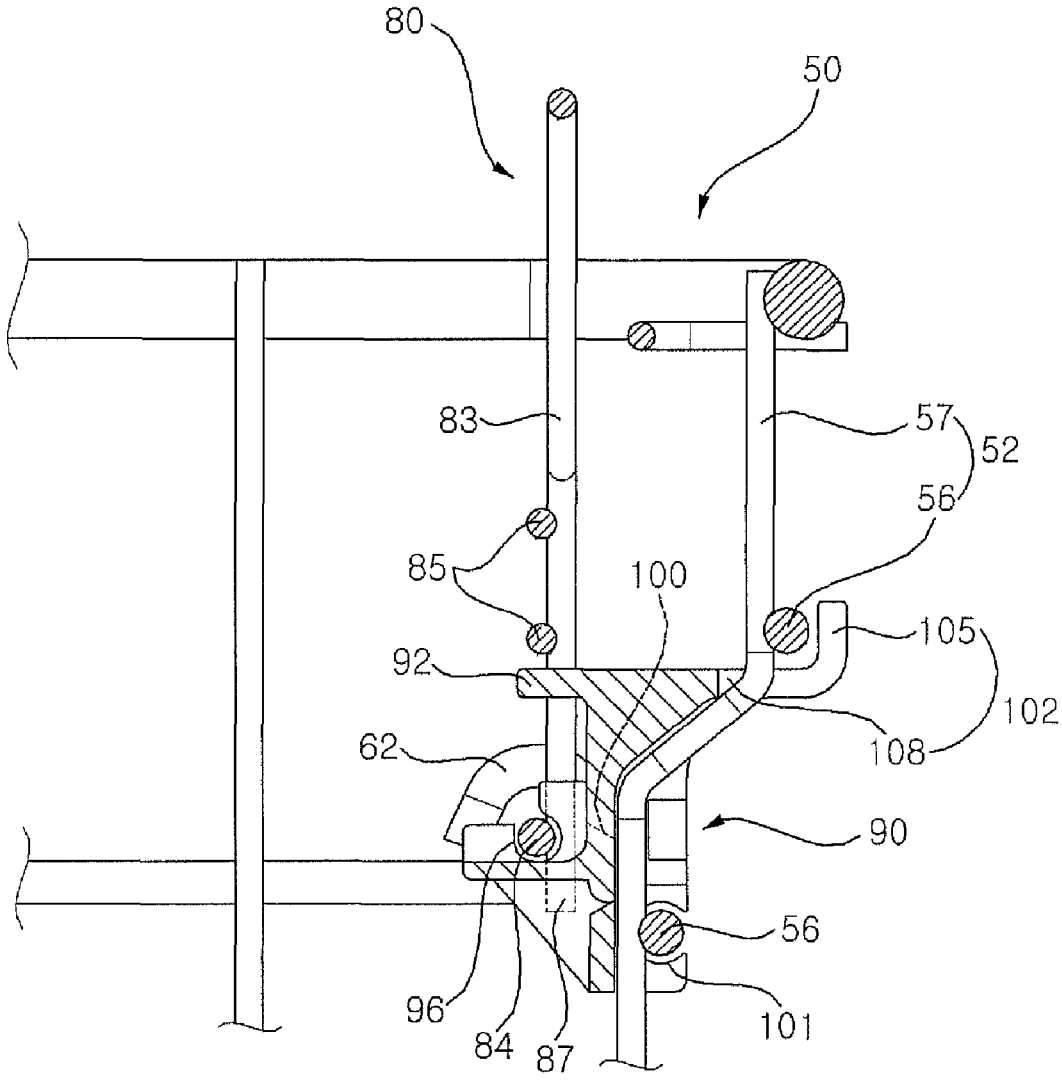
FIG. 8 is a partial cross sectional view of a rack assembly of FIG. 3, showing shelves in an uptight position.
Figure 9:
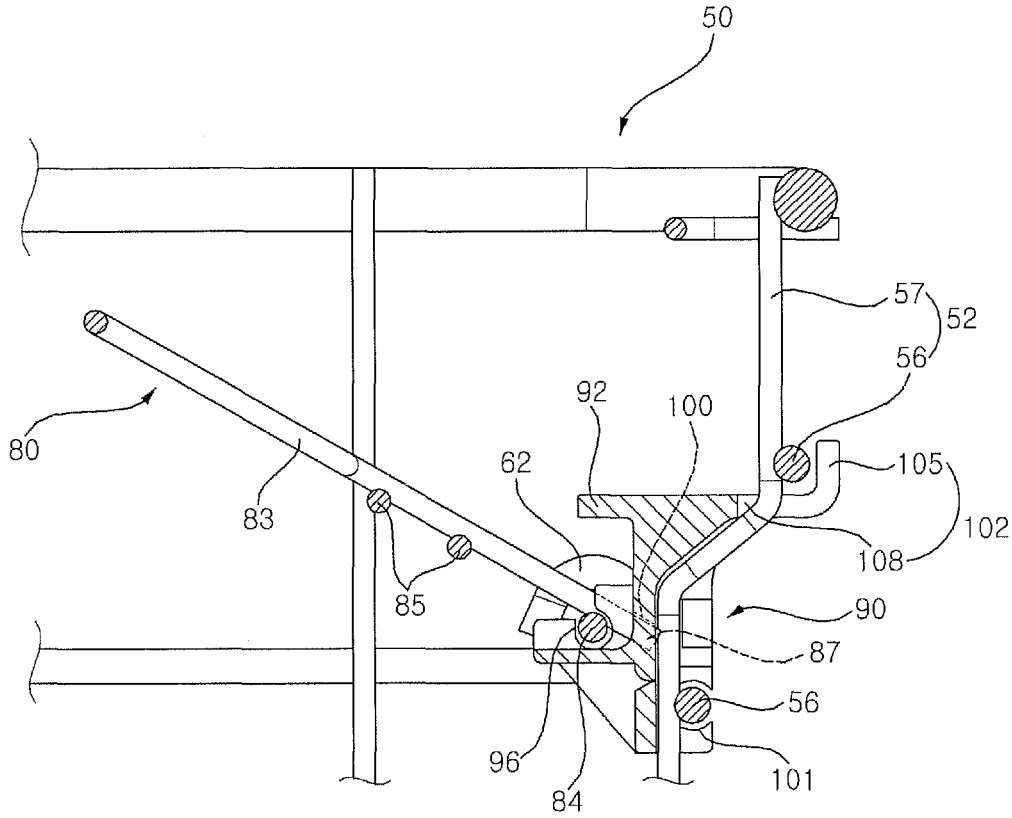
FIG. 9 is a partial cross sectional view of a rack assembly of FIG. 3, showing shelves in a laid down position.

FIG. 4 is an exploded perspective view of a rack assembly of FIG. 3. FIG. 5 is another exploded perspective view of a rack assembly of FIG. 3, showing shelves in an upright position on a rack. FIG. 6 is another exploded perspective view of a rack assembly of FIG. 3, showing shelves in a laid down position on a rack. FIG. 7 is a perspective view of a shelf holder of a rack assembly of FIG. 3. FIG. 8 is a partial cross sectional view of a rack assembly of FIG. 3, showing shelves in an upright position. FIG. 9 is a partial cross sectional view of a rack assembly of FIG. 3, showing shelves in a laid down position.

Referring to FIGS. 4 to 6, the rack 50 may be formed in the shape of a grill whose top side is opened. Further, the rack 50 may include a left side 51, a right side 52, a front side 53, a rear side 54, and a lower side 55. Each of the left side 51, right side 52, front side 53, and rear side 54 may include a plurality of horizontal bars 56 and a plurality of vertical bars 57, which may be connected perpendicularly to each other. The lower side 55 of the rack 50 may include a plurality of bars 58 that extend in a left to right direction and a plurality of bars 59 that extend in a front to rear direction, which may be connected perpendicularly to each other.

The rack 50 may also include a plurality of shelf supporters 61, 62 that pivotably support shelves 70, 80. The number of shelf supports 61, 62 may be equal to a number of shelves 70, 80.

The self supporters 61, 62 each may be provided at sides, for example, the front side 53 and rear side 54, other than the side on which the shelf holder 90 is mounted, for example, the right side 52. That is, the self supporters 61, 62 may be provided at the front side 53 and the rear side 54, respectively, in the case that the shelf holder 90 is mounted at the right side 52 of the rack 50.

The self supporters 61, 62 may be provided integrally with the front side 53 and rear side 54 of the rack 50 at a nearest location from the side 52 on which the self holder 90 is to be mounted. Thus, in the case that the shelf holder 90 is mounted on the right side 52 of the rack 50, the shelf supporters 61, 62 may be provided at the right end of the front side 53 and the right end of the rear side 54.

The shelf supporters 61, 62 may be bent in the shape of a ring, so that they wrap around a part of the shelves 70, 80 and pivotably support the wrapped part. Hereinafter, the shelf supporter provided at the right end of the front side 53 of the rack 50 will be referred to as 'front side shelf supporter 61', and the shelf supporter provided at the right end of the rear side 54 of the rack 50 will be referred to as 'rear side shelf supporter 62'.

The shelves 70, 80 may be arranged together but spacedly from each other in the forward and backward or left and right directions at the left side 51, right side 52, front side 53, and rear side 54, or may be arranged apart at one side 52 and other side 51, respectively. However, descriptions hereinafter discussed will be directed to a case in which the shelves 70, 80 are arranged together to be spaced from each other in the forward and backward direction.

Each of the shelves 70, 80 may include rack connection bars 71, 81, respectively, pivotably supported by the front side shelf supporter 61 or rear side shelf supporter 62, and shelf holder connection bars 72, 82, respectively, pivotably supported by shelf supporters 95, 96 of the shelf holder 90. The rack connection bars 71, 81 or the shelf holder connection bars 72, 82 may protrude in opposite directions from each other with respect to each of the shelves 70, 80. That is, the rack connection bar 71 may project frontward and the shelf holder connection bar 72 may project rearward in the front side shelf 70, and the rack connection bar 81 may project rearward and the shelf holder connection bar 82 project frontward in the rear side shelf 80.

Each of the shelves 70, 80 may comprise main shelf parts 73, 83 detachable from the shelf holder 90, support bars 74, 84 connected to the main shelf parts 73, 83, one end of which may be pivotably supported by the rack 50 and the other end of which may be pivotably supported by the shelf holder 90, and at least one holding bars 75, 85 connected to the main shelf parts 73, 83 to receive cups and similar dishware thereon. The support bars 74, 84 may be longer in length between the front end and the rear end than the main shelf parts 73, 83, and each of their front and rear ends may become the rack connection bars 71, 81 and the shelf holder connection bars 72, 82.

The main shelf parts 73, 83 may include bent parts 76, 86, which may be bent to protrude toward the holding bars 75, 85. A plurality of bent parts 76, 86 may be provided in the forward and backward directions so as to hold up cups and similar dishware along with the holding bars 75, 85. The holding bars 75, 85 may be arranged to extend parallel to the support bars 74, 84.

The shelf holder 90 may be mounted at a center of one side 52 of the left side 51, right side 52, front side 53, and rear side 54 not only to pivotably support the plurality of shelves 70, 80 but also to hold the shelves 70, 80 in an upright state or position. Hereinafter, the discussion will be directed to a case in which the shelf holder 90 is mounted at the center of the right side 52 of the rack 50.

The shelf holder 90 may include fixing parts 91, 92 configured to hold the shelves 70, 80 in the upright position, so that the shelves 70, 80 may be fixed with the single shelf holder 90. The fixing parts 91, 92 may each include a plurality of hooks 93, 94 facing each other so that the shelves 70, 80, particularly the main shelf parts 73, 83, may be elastically press-fitted into the hooks 93, 94.

More specifically, when the shelves 70, 80 are oriented upright, the hooks 93, 94 are pushed out by the main shelf parts 73, 83 and the interval therebetween is elastically widened, which allows the main shelf parts 73, 83 to be inserted between the hooks 93, 94. Then, the hooks 93, 94 recover their original interval therebetween, so that the main shelf parts 73, 83 may be locked to the hooks 93, 94. As such, the hooks 93, 94 may be provided so as to protrude from the upper surface of the shelf holder 90 so that their interval can be elastically widened and then recover. Discussion hereinafter will be directed to a case in which the front side fixing part 91 may be provided to protrude laterally from approximately the front part of the shelf holder 90 and the rear side fixing part 92 may be provided to protrude laterally from the approximately rear part of the shelf holder 90.

The shelf holder 90 may include a plurality of shelf supporters 95, 96 that pivotably support the shelves 70, 80, so that the shelves 70, 80 may be supported with the single shelf holder 90. The shelf supporters 95, 96 may function as bearings capable of pivotably supporting the shelves 70, 80, and may each include a plurality of grooves 97, 98, (FIG. 7) which may be spaced from each other and crooked in opposite directions from each other, so that they wrap around parts of the shelf holder connection bars 72, 82. Thus, the shelf holder connection bars 72, 82 may be pivotably supported by the grooves 97, 98. Hereinafter, discussion will be directed to a case in which the front side shelf supporter 95 may be provided at approximately the front part of the center of the shelf holder 90, and the rear side shelf supporter 96 may be provided at approximately the rear part of the center of the shelf holder 90. The shelf holder 90 may include a plurality of shelf-lying holders 99, 100 to support the shelves 70, 80 so that the shelves 70, 80 lie down horizontally substantially or in an inclined manner.

The shelf-lying holders 99, 100 may serve as a locking part locking lower protrusions 77, 87 (FIGS. 8 and 9) upwardly, which may be provided at a lower side of the shelves 70, 80, when the shelves 70, 80 are laid down substantially horizontally or in an inclined manner. If the shelf-lying holders 99, 100 are provided or extend horizontally, then the shelves 70, 80 are laid down horizontally, and if the shelf-lying holders 99, 100 are provided or extend in an inclined manner, then the shelves 70, 80 are laid down in an inclined manner. Hereinafter, the discussion will be directed to a case in which the front side shelf-lying holder 99 is provided at approximately the front part of the center of the shelf holder 90, and the rear side shelf-lying holder 100 is provided at approximately the rear part of the center of the shelf holder 90.

The shelf holder 90 may further include a connection 101 connected to any one of the plurality of horizontal bars 56 of the rack 50 and a stopper 102 to restrain the shelf holder 90 from randomly rotating around the connection 101, as shown in FIGS. 7 to 9. The connection 101 may be provided to wrap around part of any one of the horizontal bars 56 of the rack 50.

The stopper 102 may include an inside-rotation stopper part 105 protruding from the shelf holder 90 to restrict the random rotation of the shelf holder 90 in a direction of the inside of the rack 50. The inside-rotation stopper part 105 may include protrusions 106, 107 projecting upwardly from an upper surface of the shelf holder 90 so as to be locked to any one of the horizontal bars 56.

The stopper 102 may include an outside-rotation stopper part 108 provided at the upper part of the shelf holder 90 to restrict the random rotation of the shelf holder 90 in a direction of the outside of the rack 50. The outside-rotation stopper part 108 may be in the form of a groove, as shown in FIG. 7, provided on an upper surface of the shelf holder 90 so that any one of the horizontal bars 57 may be inserted into and locked to the groove.

An operation a dishwasher according to an embodiment configured as discussed above will be described herein below.

Referring to FIG. 6, first, if the front side shelf 70 is rotated in an upward direction when the shelves 70, 80 are lying down, then the front side shelf 70 rotates while the rack connection bar 71 is supported by the front side shelf supporter 61 of the rack 50 and the shelf holder connection bar 72 is supported by the front side shelf supporter 95 of the shelf holder 90. When the front side shelf 70 is rotated into an approximately upright position, a part of the main shelf part 73 elastically expands the interval between the hooks 93, 94, and is inserted between the hooks 93, 94. Referring to FIG. 5, if the front side shelf 70 is completely upright, then the hooks 93, 94 recover the original interval therebetween and restrict the part of the main shelf part 73 by locking the front side shelf 70, thus making it difficult for 70 to randomly rotate in the direction of lying down.

In the meantime, if the rear side shelf 80 is rotated in the upward direction similar to the front side shelf 70, then the rear side shelf 80 rotates while the rack connection bar 81 is supported by the rear side shelf supporter 62 of the rack and the shelf holder connection bar 82 is supported by the rear side shelf supporter 96 of the shelf holder 90. When the rear side shelf 80 is rotated into an approximately upright position similar to the front side shelf 70, a part of the main shelf part 83 elastically expands the interval between the hooks 93, 94, and is inserted between the hooks 93, 94. Referring to FIG. 5, if the rear side shelf 80 is completely upright, then the hooks 93, 94 recover the original interval therebetween and restrict the part of the main shelf part 83, thus refraining the rear side shelf 80 from randomly rotating in the direction of lying down.

That is, the main shelf part 73 of the front side shelf 70 is locked upright fixed to the front side fixing part 91 of the shelf holder 90, with the support bar 74 supported by the front side shelf supporter 95 of the shelf holder 90 and the front side shelf supporter 61 of the rack 50, and the main shelf part 83 of the rear side shelf 80 is locked upright fixed to the rear side fixing part 92 of the shelf holder 90, with the support bar 84 supported by the rear side shelf supporter 96 of the shelf holder 90 and the rear side shelf supporter 62 of the rack 50. As a consequence, the plurality of the shelves 70, 80 are in an upright position fixed by the single shelf holder 90.

On the other hand, if the front side shelf 70 is rotated in the direction of lying down, with the shelves 70, 80 fixed upright, then the part of the front side shelf 70, which has been restricted by the hooks 93, 94, elastically expands the interval between the hooks 93, 94, and is released from the hooks 93, 94, and the front shelf 70 rotates while the rack connection bar 71 and shelf holder connection 72 are supported by the front side shelf supporter 61 of the rack 50 and the front side shelf supporter 95 of the shelf holder 90. If the lower protrusion 77 of the main shelf part 73 is locked upwardly to the front side shelf-lying holder 99 of the shelf holder 90 with the rotation of the front side shelf 70, then the front side shelf 70 keeps this state without further rotation.

Similarly to the front side shelf 70, if the rear side shelf 80 is rotated in the direction of lying down, then the part of the rear side shelf 80, which has been restricted by the hooks 93, 94, is released from the hooks 93, 94, and the rear shelf 80 rotates while being supported by the rear side shelf supporter 62 of the rack 50 and the rear side shelf supporter 96 of the shelf holder 90. And, if the lower protrusion 87 of the main shelf part 83 is locked upwardly to the rear side shelf-lying holder 100 of the shelf holder 90 with the rotation of the rear side shelf 80, then the rear side shelf 80 keeps this state without further rotation.

That is, the main shelf part 73 of the front side shelf 70 is locked upwardly and fixed horizontally or in an inclined manner to the front side fixing part 99 of the shelf holder 90, with the support bar 74 supported by the front side shelf supporter 95 of the shelf holder 90 and the front side shelf supporter 61 of the rack 50, and the main shelf part 83 of the rear side shelf 80 is locked upwardly and fixed horizontally or in an inclined manner to the rear side fixing part 100 of the shelf holder 90, with the support bar 84 supported by the rear side shelf supporter 96 of the shelf holder 90 and the rear side shelf supporter 62 of the rack 50. As a consequence, the plurality of the shelves 70, 80 may be keep in the lying down state by the single shelf holder 90.

The dishwasher according to embodiments disclosed herein has at least the following advantages:

The dishwasher according to embodiments disclosed herein is capable of minimizing the number of shelf holders for fixing a plurality of shelves to a rack and, therefore, simplifying the assembly process, since a shelf holder is provided with a plurality of shelf fixing parts for uprightly fixing a plurality of shelves to the shelf holder.

In addition, the dishwasher according to embodiments disclosed herein is capable of minimizing the number of the parts without any necessity for a separate shelf supporter to pivotably support shelves to a rack, since a plurality of shelf supporters are provided on the rack to pivotably support the shelves.

Further, the dishwasher according to embodiments disclosed herein is capable of minimizing the number of shelf holders and simplifying the structure of a rack in comparison with a case where shelf supporters are only provided on the rack to pivotably support shelves since a plurality of shelf supporters are provided on the shelf holder to pivotably support the shelves.

Also, the dishwasher according to embodiments disclosed herein is capable of providing better space efficiency than prior art apparatus where a plurality of shelves are distributed at various sections, since a plurality of shelves are arranged to be spaced from one another at any one of the front, rear, left, and right sides of a rack.

Embodiments disclosed herein provide a dishwasher capable of minimizing the number of parts and simplifying the assembly process by fixing a plurality of shelves to a rack using a single or unitary shelf holder.

A dishwasher according to embodiments disclosed herein may include a rack arranged inside of a washing tank or cabinet, a plurality of shelves arranged on the rack, and a shelf holder installed on the rack. The shelf holder may include a plurality of shelf fixing parts to fix the shelves together. The rack may include a plurality of shelf supporters to pivotably support the shelves. The shelf supporters may be provided on the rack in the shape of a ring.

The shelf holder may be mounted at any one of a left side, a right side, a front side, and a rear side of the rack, and the plurality of shelf supporters may be provided at other sides. The shelf holder may be mounted at one of a left side and a right side of the rack, and the plurality of shelf supporters each may be provided at a front side and a rear side of the rack. The plurality of shelves may be arranged at one of a left side and a right side of the rack spaced from each other in a forward and backward directions.

The plurality of fixing parts may each include a plurality of hooks facing each other and protruding from the shelf holder, so that the shelves may be elastically press-fitted to the hooks. The shelf holder may include a plurality of shelf supporters to pivotably support the shelves.

The plurality of shelf supporters may each comprise a plurality of grooves, both of which are spaced from each other and crooked in the opposite direction from each other, so that they may wrap around parts of the support bars. The shelf holder may include a plurality of shelf-lying holders to support the shelves when the shelves are laid down horizontally or in an inclined manner.

The plurality of shelves may each include rack connection bars pivotably supported with the rack and shelf holder connection bars pivotably supported with the shelf holder. The rack connection bars or the shelf holder connection bars may protrude in opposite directions to each other with respect to each of the shelves.

Each of the shelves may include main shelf parts detachable to the shelf fixing parts, support bars connected to the main shelf parts, one end of which may be pivotably supported with the rack and the other end of which may be pivotably supported with the shelf holder, and holding bars connected to the main shelf parts. The main shelf parts may include bent parts, which are bent to protrude toward the holding bars. The support bars may be longer in length between the front end and the rear end than the width between the front end and the rear end of the main shelf parts.

A dishwasher according to embodiments disclosed herein may include a rack arranged inside of a washing tank or cabinet, the rack including a plurality of shelf supporters, a plurality of shelves pivotably supported with each of the shelf supporters of the rack, and a shelf holder installed at the rack, the shelf holder including a plurality of shelf fixing parts to fix the shelves upright and a plurality of shelf-lying holders to support the shelves when the shelves are laid down horizontally or in an inclined manner. Each of the shelves may include main shelf parts detachable to the shelf fixing parts, support bars connected to the main shelf parts, which may be pivotably supported with the shelf supporters and supported by the shelf-lying holders when the shelves are laid down horizontally or in an inclined manner, and holding bars connected to the main shelf parts.

A dishwasher according to embodiments disclosed herein may include a rack arranged inside of a washing tank or cabinet, the rack including a front side shelf supporter and a rear side shelf supporter, a shelf holder installed at the rack, the shelf holder including a front side shelf supporter and a rear side shelf supporter, a front side shelf pivotably supported with the front side shelf supporter of the rack and the front side shelf supporter of the shelf holder, and a rear side shelf pivotably supported with the rear side shelf supporter of the rack and the rear side shelf supporter of the shelf holder.

The shelf holder may include a front side shelf fixing part to fix the front side shelf upright and a rear side shelf fixing part to fix the rear side shelf upright. The shelf holder may include a front side shelf-lying holder to support the front side shelf when the front side shelf is laid down horizontally or in an inclined manner, and a rear side shelf-lying holder to support the rear side shelf when the rear side shelf is laid down horizontally or in an inclined manner.

The dishwasher according to embodiments disclosed herein is capable of minimizing the number of shelf holders for fixing a plurality of shelves and, therefore, simplifying the assembly process, since a shelf holder is provided with a plurality of shelf upright Fixing parts for fixing a plurality of shelves to the shelf holder.

While the embodiments have been illustrated and described, it will be appreciated that various changes can be made therein without departing from the spirit and scope of the invention. For example, it can be understood that the shelf holder 90 may be mounted at the left side 51 of the rack 50, the shelf supporters 61, 62 each may be provided at the left end of the front side 53 and the left end of the rear side 54, respectively, and the shelves 70, 80 may be arranged at the left side 51 of the rack 50 to be spaced from each other in the front to rear direction.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones or the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

at least one rack arranged inside of a washing cabinet;

a plurality of shelves arranged on the at least one rack; and a unitary shelf holder installed on the at least one rack, the unitary shelf holder comprising a plurality of shelf fixing portions that detachably fix to the plurality of shelves and a plurality of first shelf supporters that pivotably support the plurality of shelves, wherein:

the plurality of shelves rotate relative to the first shelf supporters to be spaced from the shelf fixing portions, the at least one rack comprises a plurality of second shelf supporters that pivotably support the plurality of shelves, and the unitary shelf holder is mounted at one of a left side or a right side of the at least one rack, and the plurality of second shelf supporters are provided at respective ones of a front side and a rear side of the at least one rack.

2. The dishwasher of claim 1, wherein each of the plurality of second shelf supporters are provided on the at least one rack in substantially a shape of a ring.

3. The dishwasher of claim 1, wherein the unitary shelf holder is mounted at any one of a left side, a right side, a front side, or a rear side of the at least one rack, and the plurality of second shelf supporters is provided at other ones of the sides.

4. The dishwasher of claim 1, wherein the plurality of shelves are arranged at one of a left side or a right side of the rack spaced from each other in a front to rear direction.

5. The dishwasher of claim 1, wherein each of the plurality of fixing portions includes a plurality of hooks that face each other and protrude from the unitary shelf holder, and wherein the plurality of hooks of each fixing portion is configured to receive a respective one of the plurality of shelves based on an elastic press fit coupling.

6. The dishwasher of claim 1, wherein each of the plurality of first shelf supporters comprise a plurality of grooves spaced apart from each other and offset in opposite directions to allow the grooves to wrap around different portions of a respective support bar of the plurality of shelves.

7. The dishwasher of claim 1, wherein the unitary shelf holder comprises a plurality of shelf-lying holders configured to support the plurality of shelves when the plurality of shelves are oriented substantially horizontally or inclined.

8. The dishwasher of claim 1, wherein each of the plurality of shelves comprises a rack connection bar configured to be pivotably supported by the rack and a shelf holder connection bar configured to be pivotably supported by the unitary shelf holder.

9. The dishwasher of claim 8, wherein the rack connection bar and the shelf holder connection bar are configured to protrude in opposite directions to each other.

10. The dishwasher of claim 1, wherein each of the plurality of shelves comprises:

a main shelf configured to be detachably coupled to one of the plurality of shelf fixing portions;

at least one support bar connected to the main shelf, one end of which is configured to be pivotably supported by the rack and another end of which is configured to be pivotably supported by the first shelf supporter; and at least one holding bar connected to the main shelf.

11. The dishwasher of claim 10, wherein the main shelf comprises bent parts, which are bent to protrude toward the at least one holding bar.

12. The dishwasher of claim 10, wherein the at least one support bar is longer in length between a front end and a rear end than a width between a front end and a rear end of the main shelf.

13. The dishwasher of claim 1, wherein the at least one rack is configured to be inserted into and withdrawn from the washing cabinet.

14. A dishwasher, comprising:

at least one rack arranged inside of a washing cabinet;

a plurality of shelves arranged on the at least one rack; and a unitary shelf holder installed on the at least one rack, the unitary shelf holder comprising a plurality of shelf fixing portions that detachably fix to the plurality of shelves, wherein the at least one rack comprises a plurality of second shelf supporters that pivotably support the plurality of shelves, wherein the unitary shelf holder is mounted at one of a left side or a right side of the at least one rack, and wherein the plurality of second shelf supporters are provided at respective ones of a front side and a rear side of the at least one rack.

* * * * *